US009597779B2

(12) United States Patent
Kaiser

(10) Patent No.: US 9,597,779 B2
(45) Date of Patent: Mar. 21, 2017

(54) ACTUATING DEVICE

(75) Inventor: Richard Kaiser, Bad Homburg vor der Hoehe (DE)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 13/452,016

(22) Filed: Apr. 20, 2012

(65) Prior Publication Data

US 2012/0272781 A1 Nov. 1, 2012

(30) Foreign Application Priority Data

Apr. 28, 2011 (DE) ..... 10 2011 018 988

(51) Int. Cl.
*B25B 5/12* (2006.01)
*B25B 5/16* (2006.01)

(52) U.S. Cl.
CPC ..... *B25B 5/122* (2013.01); *B25B 5/16* (2013.01); *Y10T 74/20474* (2015.01)

(58) Field of Classification Search
CPC ..... B25B 5/122; B25B 5/16
USPC ..... 74/519, 523; 269/24, 32, 201, 228
See application file for complete search history.

(56) References Cited

U.S. PATENT DOCUMENTS

| | | | | |
|---|---|---|---|---|
| 4,972,592 | A | 11/1990 | Finnern | |
| 5,171,001 | A * | 12/1992 | Sawdon | 269/32 |
| 5,884,903 | A * | 3/1999 | Sawdon | 269/32 |
| 6,416,045 | B1 * | 7/2002 | Morroney | 269/32 |
| 6,612,557 | B2 * | 9/2003 | Sawdon et al. | 269/32 |
| 2009/0224455 | A1 * | 9/2009 | Kaiser et al. | 269/216 |
| 2010/0044942 | A1 * | 2/2010 | Tamai | 269/32 |

FOREIGN PATENT DOCUMENTS

| | | |
|---|---|---|
| DE | 8800633 | 1/1988 |
| DE | 3717580 | 12/1988 |
| DE | 19645778 | 5/1998 |
| DE | 602004010217 | 10/2008 |
| FR | 843735 | 7/1939 |

* cited by examiner

*Primary Examiner* — Vicky Johnson
(74) *Attorney, Agent, or Firm* — Harness, Dickey & Pierce, P.L.C.

(57) ABSTRACT

An actuating device has an actuating element connected in a rotationally-fixed manner to a shaft. The shaft is mounted so that it is rotatable in the housing. The actuating element is pivotable using a hand lever connected to the shaft. The hand lever is formed from an attachment element connected to the shaft and an elongated handle element fastened on the attachment element. The handle element is fastenable at different positions on a front side of the attachment element. The front side of the attachment element is oriented perpendicularly to a main axial direction of the shaft.

9 Claims, 1 Drawing Sheet

ACTUATING DEVICE

CROSS-REFERENCE TO RELATED APPLICATIONS

This application claims the benefit and priority of German Patent Application No. 10 2011 018 988.2, filed Apr. 28, 2011. The entire disclosure of the above application is incorporated herein by reference.

FIELD

The disclosure relates to an actuating device and, more particularly, to an actuating device with a handle that is secured in different positions with respect to the shaft.

BACKGROUND

An actuating device is known according to DE 196 45 778 A1. This actuating device, which is implemented as a clamping device, has an actuating element (clamping arm), that is connected in a rotationally fixed manner to a shaft that is rotatable in a housing. The actuating element is pivotable using a hand lever connected to the shaft. The hand lever is formed from an attachment element connected to the shaft. An elongated handle element is fastened on it. In this solution, the handle element is fixedly connected to the attachment element. The attachment element itself can be fastened in four different positions on the shaft since the shaft has a square cross section perpendicular to its main axial direction.

The disclosure improves the actuating element of the above mentioned type. In particular, the flexibility of the attachment of the hand lever to the actuating device is improved.

An actuating device comprises an actuating element, which is connected in a rotationally-fixed manner to a shaft mounted so it is rotatable in a housing. The actuating element is pivotable using a hand lever connected to the shaft. The hand lever is formed from an attachment element connected to the shaft and an elongated handle element fastened to it. The handle element is fastenable at different positions on a front side of the attachment element. The front side is oriented perpendicularly to the main axial direction of the shaft.

Thus, the handle element is fastenable at different positions to the front side of the attachment element oriented perpendicularly to the main axial direction of the shaft.

SUMMARY

According to the disclosure, the fastening of the handle element no longer occurs on a peripheral surface of the attachment element, but rather on its (shaft-free) front side. Depending on the diameter of the attachment element, its outer peripheral surface (cylinder lateral surface) is relatively small. The number of possible fastening points is limited, for example, to four places, as in the solution according to DE 60 2004 010 217 T2. In contrast, even with a small diameter of the attachment element, a relatively large number of fastening points for the handle element can be provided on the front side of the attachment element. The attachment of the hand lever to the actuating device can be more precisely adapted to the actual spatial conditions at the usage location.

Further areas of applicability will become apparent from the description provided herein. The description and specific examples in this summary are intended for purposes of illustration only and are not intended to limit the scope of the present disclosure.

DRAWINGS

The actuating device according to the disclosure, including the advantageous refinements according to the claims, is explained in greater detail on the basis of the illustration in the drawing of various exemplary embodiments.

DETAILED DESCRIPTION

Figure 1:
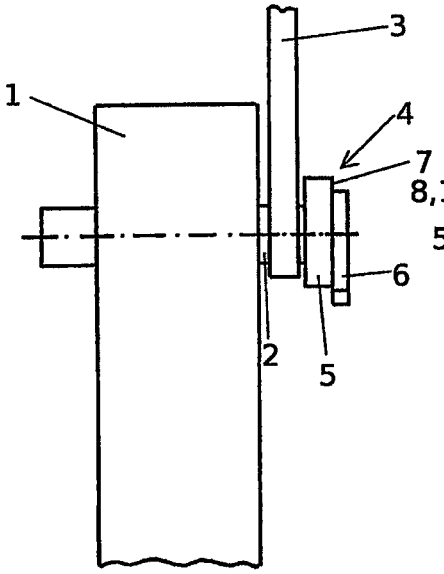
FIG. 1 is a schematic view of a first embodiment of the actuating element from a first viewing direction.
Figure 2:
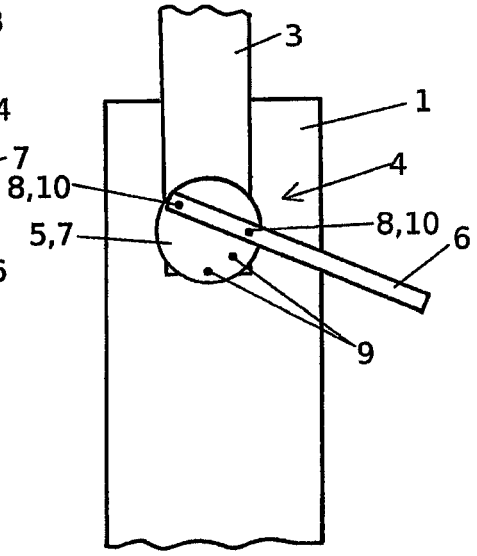
FIG. 2 is a schematic view of the actuating element according to FIG. 1 from a second viewing direction.
Figure 4:
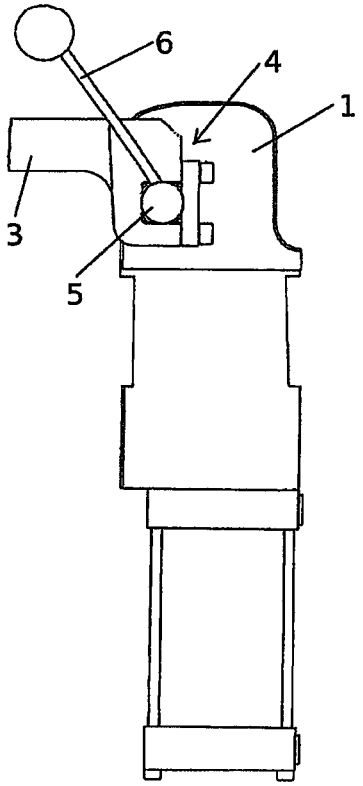
FIG. 4 is a side view of a prior art actuating or clamping device.

The actuating or clamping devices shown in FIGS. 1, 2, and 4 include, in a known manner, an actuating element 3 that is connected to a shaft 2 in a rotationally-fixed manner. The shaft 2 is rotatably mounted in a housing 1. The shaft 2 typically has a polygonal cross section perpendicular to its main axial direction, which is indicated by dashed lines in FIG. 1.

With respect to the disclosure to be explained hereafter, a square cross section, which is also known per se, is particularly preferably provided, because, for example, a hexagonal cross section typically causes higher manufacturing costs.

The actuating element 3 is pivotable using a hand lever 4 connected to the shaft 2. The hand lever 4 is formed from an attachment element 5. The attachment element 5 is connected to the shaft 2 and is preferably arranged on the free end of the shaft 2. An elongated handle element 6 is fastened to the attachment element 5.

Figure 3:
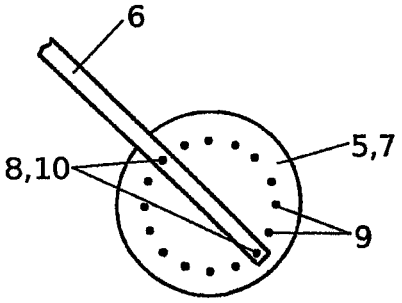
FIG. 3 is a schematic view of a top view of a second embodiment of the attachment element with a handle element.

Although it is not shown separately in FIGS. 1 to 3, a handle, that has a spherical shape as in FIG. 4, for example, is arranged on the end of the handle element 6 facing away from the attachment element. However, the handle can also, just as well, include a corresponding plastic or rubber coating. This is true, in particular, if the handle element 6 is a flat bar with a rectangular cross section.

The shaft 2 can include a hollow shaft and an inner shaft. The actuating element 3 is connected in a rotationally-fixed manner to the hollow shaft. The attachment element 5 is connected in a rotationally-fixed manner to the inner shaft.

In all embodiments of the actuating device of the disclosure, the handle element 6 is fastenable at different positions on a front side 7 of the attachment member. The front side 7 of the attachment element 6 is oriented to be at least substantially perpendicular to the main axial direction of the shaft 2. As explained at the beginning, particular advantages result from this measure with respect to a flexible arrangement or assignment of the handle element 6 to the actuating device. As shown in FIGS. 1 to 3, the attachment element 5 is preferably disc-shape. A disc is understood as a cylinder whose thickness is less (optionally by a multiple) than its radius.

The handle element 6 is fastened to the attachment element 5 by two fastening connections 8. The fastening connections 8 are positioned at a distance from one another. The fastening connections 8 are each formed from one attachment-element-side and one handle-element-side fastening element 9, 10. The fastening elements 9, 10 include, for example, corresponding threaded holes and screws or threaded rods and nuts. The fastening connection 8 is preferably a screw connection. Furthermore, two through holes for two corresponding fastening elements 9, 10 are provided on the handle element 6.

Multiple attachment-element-side fastening elements or receivers 9, for example, threaded holes, are arranged on the attachment element 5. Not all attachment-element-side fastening elements or receivers 9 can be recognized in FIGS. 2 and 3. Two fastening elements or receivers 9 are concealed by the handle element 6. The corresponding handle-element-side fastening elements 10, for example, as mentioned, are screws.

In both the embodiments according to FIGS. 1 and 2 and also in the embodiment according to FIG. 3, multiple attachment-element-side fastening elements or receivers 9 are arranged on an imaginary circular path.

In the solution according to FIG. 3, all (16) attachment-element-side fastening elements 9 are positioned on an imaginary circle. The distance between the two fastening connections 8 corresponds to the diameter of the circle.

In FIGS. 1 and 2, one attachment-element-side fastening element 9, concealed in FIG. 2 by the handle-element-side fastening element 10, is provided as the center point of an imaginary circular path having further attachment-element-side fastening elements 9. The center point of the imaginary circular path is arranged on one side, on the left in FIG. 2. The further (three) fastening elements 9 are arranged on an opposite side, on the right in FIG. 2, of the attachment element 5. As is obvious, in this solution only, the (complete) detachment of one fastening element 10 is necessary to adjust the handle element 6 in relation to the attachment element 5.

Finally, it is to be noted in this context that FIG. 2 does appear to only disclose a total of three setting positions. In consideration of the fact that the attachment element 5 is connectable in four different positions to the shaft 2, which has a square cross section, 12 different positions are actually possible for the handle element 6 according to the disclosure.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. An actuating device comprising:

an actuating element connected in a rotationally-fixed manner to a shaft, the actuating element contacts a work piece, the shaft is mounted so that it is rotatable in a housing, the actuating element is positioned externally of the housing and contacts the work piece externally of the housing, the actuating element is pivotable using a hand lever connected to the shaft, the hand lever is formed from an attachment element connected to the shaft and a manually manipulated elongated handle element, the attachment element being dividable into first and second halves and including at least one fastener receiver on the first half and a plurality of fastener receivers positioned on the second half, the elongated handle fastened on the attachment element such that a first fastener secures with the at least one fastener receiver on the first half of the attachment element and a second fastener secures with one of the plurality of fastener receivers on the second half of the attachment element and the first and second fasteners are on opposite sides of a line bisecting a line that divides the attachment element in half; and the handle element is fastenable at different positions on a front side face of the attachment element so that the handle element is multi-positionable on the front side face of the attachment element and fastenable to the front side face of the attachment element so that the handle element is attached at the attachment element, at different positions on the front side face of the attachment element, and the front side face of the attachment element is oriented perpendicularly to a main axial direction of the shaft.

2. The actuating device according to claim 1, wherein a fastening connection is formed from the attachment-element-side fastener receiver and a handle-element-side fastening element.

3. The actuating device according to claim 2, wherein two through holes are provided for the attachment-element-side fastener receivers and two through holes are provided to define handle-element-side fastening elements on the handle element.

4. The actuating device according to claim 1, wherein the at least one and the plurality of attachment-element-side fastening receivers are arranged on an imaginary circular path.

5. The actuating device according to claim 4, wherein the at least one attachment-element-side fastening receiver is provided as a center point of the imaginary circular path.

6. The actuating device according to claim 5, wherein the center point of the imaginary circular path is arranged on the first half of the attachment element.

7. The actuating device according to claim 1, wherein the handle element is a flat bar with a rectangular cross section.

8. The actuating device according to claim 1, wherein the attachment element is disc-shaped.

9. An actuating device comprising:

an actuating element connected in a rotationally-fixed manner to a shaft, the actuating element contacts a work piece, the shaft is mounted so that it is rotatable in a housing, the actuating element is positioned externally of the housing and contacts the work piece externally of the housing, the actuating element is pivotable using a hand lever connected to the shaft, the hand lever is formed from an attachment element connected to the shaft and a manually manipulated elongated handle element, the attachment element being dividable into first and second halves and including at least one fastener receiver on the first half and a plurality of fastener receivers positioned on the second half, the elongated handle fastened on the attachment element such that a first fastener secures with the at least one fastener receiver on the first half of the attachment element and a second fastener secures with one of the plurality of fastener receivers on the second half of the attachment element and the first and second fasteners are on opposite sides of a line bisecting a line that divides the attachment element in half; and the handle element is fastenable at different positions on a front side face of the attachment element so that the handle element is multi-positionable on the front side face of the attachment element and fastenable to the front side face of the attachment element so that when the handle element is fastened at the different positions, this enables the hand lever to be adapted to spatial conditions at a usage location, the front side face of the attachment element is oriented perpendicularly to a main axial direction of the shaft.

* * * * *